US006582055B1

(12) United States Patent
Biddle et al.

(10) Patent No.: US 6,582,055 B1
(45) Date of Patent: Jun. 24, 2003

(54) METHOD FOR OPERATING A PRINTER HAVING VERTICALLY OFFSET PRINTHEADS

(75) Inventors: Mary Ellen Ellison Biddle, Lexington, KY (US); James Daniel Weeks, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/924,181

(22) Filed: Aug. 7, 2001

(51) Int. Cl.[7] ..... B41J 2/15

(52) U.S. Cl. ..... 347/40; 347/12; 347/19; 347/41

(58) Field of Search ..... 347/40, 12, 41, 347/43, 15, 16, 14, 19

(56) References Cited

U.S. PATENT DOCUMENTS

| | | | |
|---|---|---|---|
| 4,190,845 | A | 2/1980 | Cooper et al. |
| 4,364,060 | A | 12/1982 | Jinnai et al. |
| 4,626,867 | A | 12/1986 | Furukawa et al. |
| 5,117,374 | A | 5/1992 | Goetz |
| 5,124,720 | A | 6/1992 | Schantz |
| 5,155,499 | A | 10/1992 | Goetz et al. |
| 5,276,467 | A | 1/1994 | Meyer et al. |
| 5,289,208 | A | 2/1994 | Haselby |
| 5,349,375 | A | 9/1994 | Bolash et al. |
| 5,350,929 | A | 9/1994 | Meyer et al. |
| 5,376,958 | A | 12/1994 | Richtsmeier et al. |
| 5,455,607 | A | 10/1995 | Rhoads et al. |
| 5,455,610 | A | 10/1995 | Harrington |
| 5,510,815 | A | 4/1996 | Linder et al. |
| 5,530,460 | A | 6/1996 | Wehl |
| 5,534,895 | A | 7/1996 | Lindenfelser et al. |
| 5,539,434 | A | 7/1996 | Fuse |
| 5,541,625 | A | 7/1996 | Holstun et al. |
| 5,568,168 | A | 10/1996 | Watanbe |
| 5,574,484 | A | 11/1996 | Cowger |
| 5,581,284 | A | 12/1996 | Hermanson |
| 5,602,574 | A | 2/1997 | Williams |
| 5,654,744 | A | 8/1997 | Nicoloff, Jr. et al. |
| 5,742,304 | A | 4/1998 | Richtsmeier et al. |
| 5,764,254 | A | 6/1998 | Nicoloff, Jr. et al. |
| 5,774,145 | A | 6/1998 | Morita et al. |
| 5,777,637 | A | 7/1998 | Takada et al. |
| 5,777,638 | A | 7/1998 | Salter et al. |
| 5,782,184 | A | 7/1998 | Albertalli et al. |
| 5,796,414 | A | 8/1998 | Sievert et al. |
| 5,838,343 | A | 11/1998 | Chapin et al. |
| 5,844,585 | A | 12/1998 | Kurashima et al. |
| 5,880,749 | A | 3/1999 | Kikkawa et al. |
| 5,880,757 | A | 3/1999 | Ta |
| 5,900,891 | A | 5/1999 | Shimoda |
| 5,903,290 | A | 5/1999 | Nicoloff, Jr. et at. |
| 5,907,337 | A | 5/1999 | Tajika et al. |
| 5,949,451 | A | 9/1999 | Takagi |
| 5,956,056 | A | 9/1999 | Kaneko et al. |
| 5,959,645 | A | 9/1999 | Gondek |
| 5,959,646 | A | 9/1999 | Bates et al. |
| 6,419,341 | B1 * | 7/2002 | Nohata et al. ..... 347/19 |

* cited by examiner

*Primary Examiner*—Lamson Nguyen

(57) ABSTRACT

A method for operating a printer having vertically offset printheads each having an array of nozzles. A method step includes printing in a first mode which enables a larger number or all of the nozzles of the printheads. Another step includes printing in a second mode which enables only nozzles defining a common print region for the printheads. In one example, the first and second modes occur in different raster lines of the same sheet of print medium. In another example, the first and second modes occur in different print jobs.

20 Claims, 2 Drawing Sheets

METHOD FOR OPERATING A PRINTER HAVING VERTICALLY OFFSET PRINTHEADS

TECHNICAL FIELD

The present invention relates generally to printers, and more particularly to a method for operating a printer wherein the printer has vertically offset printheads.

BACKGROUND OF THE INVENTION

Printers include color ink jet printers having black, cyan, magenta, and yellow printheads mounted on a carrier system. Each printhead includes a column of nozzles. The carrier system moves perpendicular to the direction of movement of the print medium. Conventional ink jet printers include those which compensate for vertically offset printheads by enabling only commonly-aligned ones of the nozzles of the printheads, such commonly-aligned ones of the nozzles defining a common print region of the printheads. It is known to operate a printer in a draft mode by printing a raster line in one pass of the printheads and by advancing the paper between raster lines. It also is known to operate a printer in a shingling mode by printing a raster line in several passes of the printheads without advancing the paper between passes and by advancing the paper between raster lines.

What is needed is an improved method for operating a printer.

SUMMARY OF THE INVENTION

A first method of the invention is for operating a printer having vertically offset first and second printheads, wherein the first printhead has a first array of nozzles and wherein the second printhead has a second array of nozzles. The first method includes steps a) and b). Step a) includes printing in a first mode which enables a number "M" of vertically consecutive nozzles in the first array and which enables a number "N" of vertically consecutive nozzles in the second array. Step b) includes printing in a second mode which enables only a number "m" of vertically consecutive nozzles in the first array and which enables only a number "n" of vertically consecutive nozzles in the second array, wherein "M" is greater than "m", "N" is greater than "n", and the "m" and "n" vertically consecutive nozzles define a common print region.

A second method of the invention is for operating a printer having vertically offset first and second printheads, wherein the first printhead has a first array of nozzles printing a first color and wherein the second printhead has a second array of nozzles printing a second color different from the first color. The method includes steps a) through d). Step a) includes advancing the print medium a first distance to a next raster line to be printed in a first mode. Step b) includes printing in the first mode which enables a number "M" of vertically consecutive nozzles in the first array and which enables a number "N" of vertically consecutive nozzles in the second array. Step c) includes advancing the print medium a second distance to a next raster line to be printed in a second mode, wherein the first distance is greater than the second distance. Step d) includes printing in the second mode which enables only a number "m" of vertically consecutive nozzles in the first array and which enables only a number "n" of vertically consecutive nozzles in the second array, wherein "M" is greater than "m", "N" is greater than "n", "M" equals "N","m" equals "n", and the "m" and "n" vertically consecutive nozzles define a common print region.

A third method of the invention is for operating a printer having vertically offset first and second printheads, wherein the first printhead has a first array of nozzles and wherein the second printhead has a second array of nozzles. The method includes steps a) and b). Step a) includes printing a first raster line which enables all of the nozzles in one of first and second arrays when the first raster line does not require printing by the other of the first and second arrays. Step b) includes printing a second raster line which enables only common-print-region ones of the nozzles in the first and second arrays when the second raster line requires printing by both the first and second arrays.

Several benefits and advantages are derived from one or more of the methods of the invention. In one example, printing in a first mode which enables all of the nozzles in the arrays of the vertically offset printheads provides a greater-height raster line such as when printing all raster lines in a draft mode, or when printing a raster line in a quality mode which calls for only one printhead or only aligned printheads. In the same or another example, printing in a second mode which enables only common-print-region ones of the nozzles of the printheads corrects for vertically offset printheads such as when printing all raster lines in a quality mode, or when printing only those raster lines in a quality mode which call for vertically offset printheads. Operating a printer to print in the first and second modes in different print jobs or in the same print job and even on the same sheet of print medium increases the efficiency of the printing operation.

DETAILED DESCRIPTION

Figure 1:
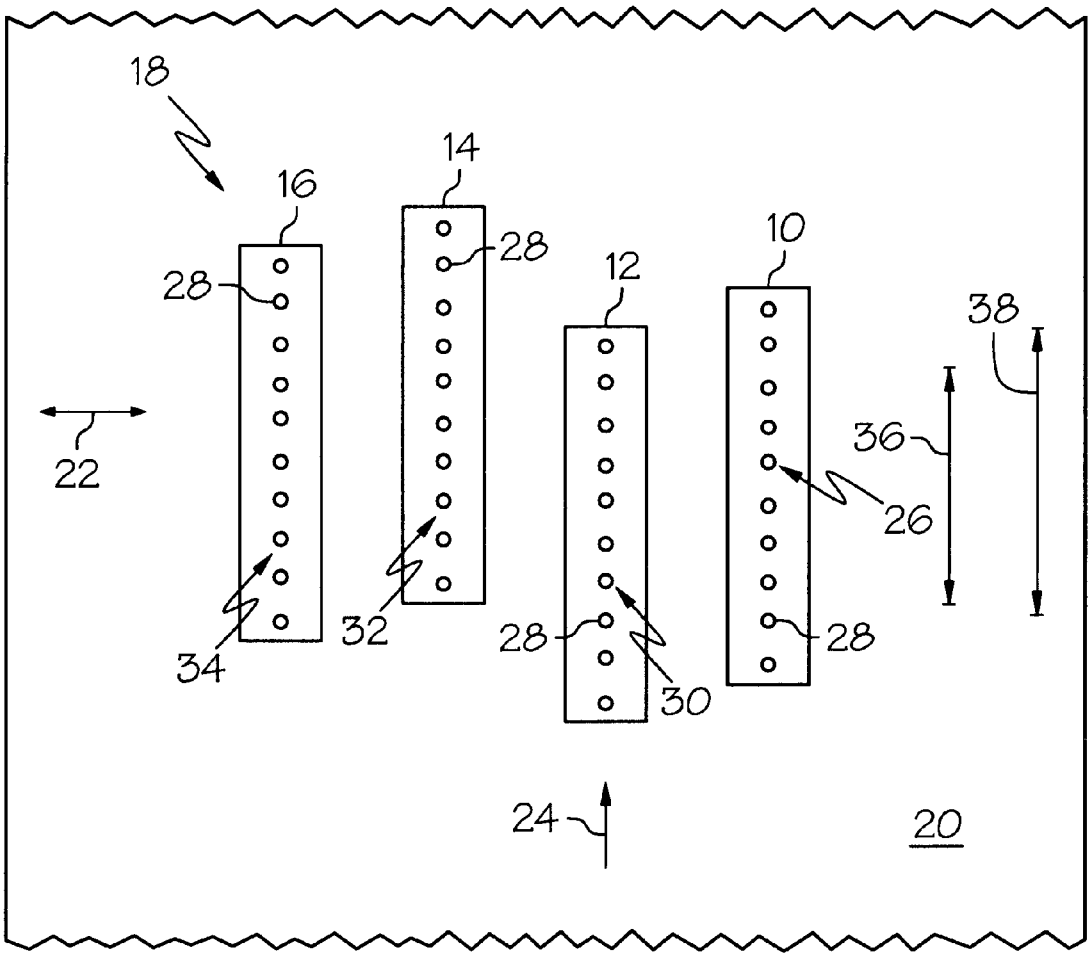
FIG. 1 is a schematic, front elevational view of an embodiment of four vertically offset printheads of a printer operable by the methods of the invention.

FIG. 1 illustrates a first embodiment of vertically offset printheads 10, 12, 14 and 16 of a printer 18 (only the printhead portion of which is shown in FIG. 1) operable by the methods of the invention. Typically, the offset is unintentional and is the result of manufacturing tolerances. Techniques to determine the vertical offset of printheads and to determine a common print region for vertically offset printheads are well known to the artisan and are not considered to be part of the present invention. The printheads 10, 12, 14 and 16 are mounted on a carrier system (not shown) which moves across a print medium 20. The direction of movement of the printheads as they make one or more print passes to print a raster line on the print medium 20 is indicated by the double arrowhead line 22. The direction of movement of the print medium 20 between printing of raster lines is indicated by the directional line 24. The first printhead 10 has a first array 26 of nozzles 28, and the second printhead 12 has a second array 30 of nozzles 28. Likewise, the third printhead 14 has a third array 32 of nozzles 28, and the fourth printhead 16 has a fourth array 34 of nozzles 28. In one example, the nozzles 28 of the first array 26 eject ink of yellow color, the nozzles 28 of the second array 30 eject ink of magenta color, the nozzles 28 of the third array 32 eject ink of cyan color, and the nozzles 28 of the fourth array 34 eject ink of black color. In this example, each array 26, 30, 32 and 34 has ten nozzles. A common print region 36 of six vertically consecutive nozzles 28 of the arrays 26, 30, 32 and 34 is shown to be less than the maximum common print region 38 of seven vertically consecutive nozzles 28 of the arrays 26, 30, 32 and 34.

The methods of the invention are applicable to any printer having at least two vertically offset printheads each having an array of nozzles and are not limited to the number or structure of printheads 10, 12, 14 and 16 or nozzles 28 shown in FIG. 1. Thus, the term "printhead" includes any array of print nozzles such as, without limitation, a print cartridge, a print pen, an array of single-color nozzles on a multi-color nozzle printhead, etc. Although the first array 26 is shown in FIG. 1 as having a single column of nozzles 28, an example (not shown), without limitation, of another first array is a first array having first and second horizontally separated columns of nozzles with a nozzle of the first column spaced vertically between two adjoining nozzles of the second column. In this example, the terminology "vertically consecutive nozzles" means nozzles 1, 2, 3, 4, etc. wherein the nozzles of the first column are numbered 1, 3, 5, etc. and the nozzles of the second column are numbered 2, 4, 6, etc. In one modification (not shown) of this example, each or groups of nozzles in the first column are slightly horizontally separated in a stepwise fashion and are fired with a time delay (as are the nozzles in the second column), as is understood by those skilled in the art.

Figure 2:
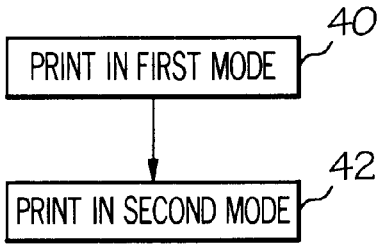
FIG. 2 is a block diagram of the steps of a first method of the invention.

A first method of the invention is for operating a printer 18 having vertically offset first and second printheads 10 and 12 wherein the first printhead 10 has a first array 26 of nozzles 28 and wherein the second printhead 12 has a second array 30 of nozzles 28. The method includes steps a) and b). Step a) is labeled as "Print In First Mode" in block 40 of FIG. 2. Step a) includes printing in a first mode which enables a number "M" of vertically consecutive nozzles 28 in the first array 26 and which enables a number "N" of vertically consecutive nozzles 28 in the second array 30. The term "enables" means that a nozzle is considered to be available to participate in printing. Enabled nozzles print when directed to do so unless they don't work because they are clogged, etc. Non-enabled nozzles are not considered to be available to participate at all in printing. Step b) is labeled as "Print In Second Mode" in block 42 of FIG. 2. Step b) includes printing in a second mode which enables only a number "m" of vertically consecutive nozzles 28 in the first array 26 and which enables only a number "n" of vertically consecutive nozzles 28 in the second array 30, wherein "M" is greater than "m", "N" is greater than "n", and the "m" and "n" vertically consecutive nozzles 28 define a common print region 36.

In one example of the first method, the total number of nozzles 28 in the first array 26 is "M", and the total number of nozzles 28 in the second array 30 is "N". In this example, all of the nozzles 28 of the first and second arrays 26 and 30 are enabled when printing in the first mode. In one variation, the common print region 36 is smaller than the maximum common print region 38. In the embodiment shown in FIG. 1, M equals N equals ten, and m equals n equals six. In this embodiment, the common print region 36 of each of the first and second arrays 26 and 30 of the first and second printheads 10 and 12 has six vertically consecutive nozzles 28. It is noted that the maximum common print region 38 for the four arrays 26, 30, 32 and 34 has seven vertically consecutive nozzles 28. In one modification, the number "m" is a predetermined fixed number which does not vary with the amount of vertical offset of the first and second printheads 10 and 12. In one variation, the "m" enabled nozzles are all working nozzles 28. In this variation, the common print region 36 is chosen such that there are no plugged or otherwise non-working nozzles.

In one application of the first method, the first mode is a lower quality print mode, and the second mode is a higher quality print mode. In this application, the first mode makes fewer print passes per raster line than does the second mode. In one implementation, the first mode makes only one print pass per raster line. In one example, the first mode is a draft mode which prints a raster line in one pass of the printheads wherein the paper is advanced between raster lines. In the same or different example, the second mode is a shingling mode which prints a raster line in several passes of the printheads without advancing the paper between passes wherein the paper is advanced between raster lines. In one printing procedure, the print medium 20 is advanced a greater distance to the next raster line in the first mode than in the second mode. In one execution of the first method, the printing in the first and second modes occurs on the same sheet of print medium. 20. An example of this is where the first mode is used when one raster line calls for printing by just the first and not the second printhead and where the second mode is used when another raster line calls for printing by both the first and second printheads. In another execution of the first method, the printing in the first mode occurs during a first print job and the printing in the second mode occurs during a second print job.

Describing the first method as enabling nozzles 28 in the first and second arrays 26 and 30 covers two variations for the embodiment of FIG. 1. In one variation, the nozzles 28 in the third and/or fourth arrays 32 and 34 in the embodiment of FIG. 1 are also likewise enabled. In the other variation, the nozzles 28 in the third and/or fourth arrays 32 and 34 are not enabled.

Figure 3:
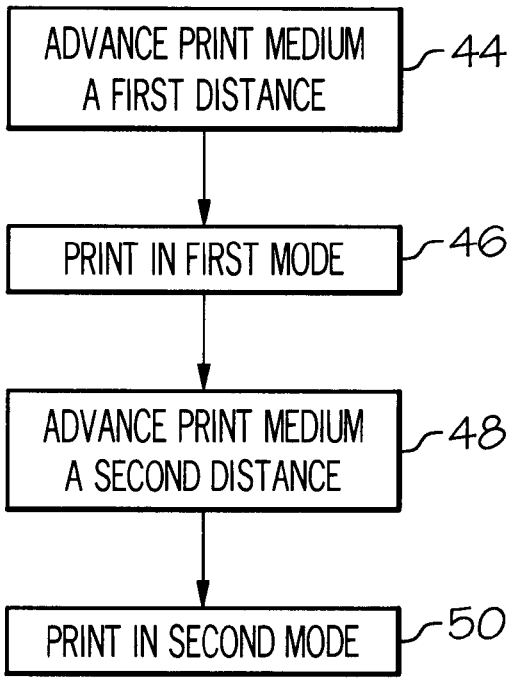
FIG. 3 is a block diagram of the steps of a second method of the invention.

A second method of the invention is for operating a printer 18 having vertically offset first and second printheads 10 and 12 wherein the first printhead 10 has a first array 26 of nozzles 28 printing a first color and wherein the second printhead 12 has a second array 30 of nozzles 28 printing a second color different from the first color. The method includes steps a) through d). Step a) is labeled as "Advance Print Medium A First Distance" in block 44 of FIG. 3. Step a) includes advancing the print medium 20 a first distance to a next raster line to be printed in a first mode. In one example of the four-printhead embodiment of FIG. 1, the lowest bottom nozzle 28 of the four printheads (which is the bottom nozzle 28 of printhead 12) is chosen as a reference in advancing the print medium 20 for step a). Step b) is labeled as "Print In First Mode" in block 46 of FIG. 3. Step b) includes printing in the first mode which enables a number "M" of vertically consecutive nozzles 28 in the first array 26 and which enables a number "N" of vertically consecutive nozzles 28 in the second array 30. Step c) is labeled as "Advance Print Medium A Second Distance" in block 48 of FIG. 3. Step c) includes advancing the print medium 20 a second distance to a next raster line to be printed in a second mode, wherein the first distance is greater than the second distance. In one example of the four-printhead embodiment of FIG. 1, the common printhead region 36 includes the highest bottom nozzle 28 of the four printheads (which is the bottom nozzle 28 of printhead 14) is chosen as a reference in advancing the print medium 20 for step c). Step d) is labeled as "Print In Second Mode" in block 50 of FIG. 3.

Step d) includes printing in the second mode which enables only a number "m" of vertically consecutive nozzles 28 in the first array 26 and which enables only a number "n" of vertically consecutive nozzles 28 in the second array 30, wherein "M" is greater than "m", "N" is greater than "n", "M" equals "N", "m" equals "n", and the "m" and "n" vertically consecutive nozzles define a common print region. In one embodiment, "M" equals 160 and "m" equals 152.

In one example of the second method, the printing in the first mode occurs in a first print job and the printing in the second mode occurs in a second print job. In another example of the second method, the printing in the first and second modes occurs in the same print job. In one implementation of the second method, "m" is a predetermined fixed number.

Figure 4:
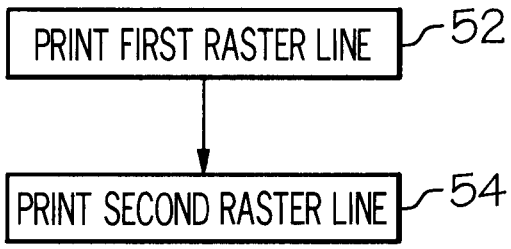
FIG. 4 is a block diagram of the steps of a third method of the invention.

A third method of the invention is for operating a printer 18 having vertically offset first and second printheads 10 and 12 wherein the first printhead 10 has a first array 26 of nozzles 28 and wherein the second printhead 12 has a second array 30 of nozzles 28. The method includes steps a) and b). Step a) is labeled as "Print First Raster Line" in block 52 of FIG. 4. Step a) includes printing a first raster line which enables all of the nozzles 28 in one of first and second arrays 26 and 30 when the first raster line does not require printing by the other of the first and second arrays 26 and 30. Step b) is labeled as "Print Second Raster Line" in block 54 of FIG. 4. Step b) includes printing a second raster line which enables only common-print-region ones of the nozzles 28 in the first and second arrays 26 and 30 when the second raster line requires printing by both the first and second arrays 26 and 30.

In one example of the third method, the nozzles 28 of the first array 26 print a first color and the nozzles 28 of the second array 30 print a second color different from the first color. In one implementation of the third method, the first and second raster lines are printed in the same print job. In another implementation of the third method, the first and second raster lines are printed in different print jobs. In one application of the third method, the first raster line is printed in one pass and the second raster line is printed in more than one pass. In the same or different application, the second raster line is printed using a predetermined fixed number of common-print-region ones of the nozzles 28 of the first and second arrays 26 and 30.

It is noted that any of the examples, implementations, applications, etc. previously described for one of the first, second and third methods of the invention is applicable to either or both of the other two of the first, second and third methods of the invention.

Several benefits and advantages are derived from one or more of the methods of the invention. In one example, printing in a first mode which enables all of the nozzles in the arrays of the vertically offset printheads provides a greater-height raster line such as when printing all raster lines in a draft mode, or when printing a raster line in a quality mode which calls for only one printhead or only aligned printheads. In the same or another example, printing in a second mode which enables only common-print-region ones of the nozzles of the printheads corrects for vertically offset printheads such as when printing all raster lines in a quality mode, or when printing only those raster lines in a quality mode which call for vertically offset printheads. Operating a printer to print in the first and second modes in different print jobs or in the same print job and even on the same sheet of print medium increases the efficiency of the printing operation.

The foregoing description of several methods of the invention has been presented for purposes of illustration. It is not intended to be exhaustive or to limit the invention to the precise methods disclosed, and obviously many modifications and variations are possible in light of the above teaching. It is intended that the scope of the invention be defined by the claims appended hereto.

What is claimed is:

1. A method for operating a printer having vertically offset first and second printheads, wherein the first printhead has a first array of nozzles, wherein the second printhead has a second array of nozzles, and wherein the method comprises the steps of:

a) printing in a first mode which enables a number "M" of vertically consecutive nozzles in the first array and which enables a number "N" of vertically consecutive nozzles in the second array; and b) printing in a second mode which enables only a number "m" of vertically consecutive nozzles in the first array and which enables only a number "n" of vertically consecutive nozzles in the second array, wherein "M" is greater than "m", "N" is greater than "n", and the "m" and "n" vertically consecutive nozzles define a common print region.

2. The method of claim 1, wherein the total number of nozzles in the first array is "M" and wherein the total number of nozzles in the second array is "N".

3. The method of claim 1, wherein the common print region is smaller than a maximum common print region of the "M" and "N" vertically consecutive nozzles.

4. The method of claim 1, wherein the number "m" is a predetermined fixed number.

5. The method of claim 1, wherein the first mode is a lower quality print mode and wherein the second mode is a higher quality print mode.

6. The method of claim 1, wherein the first mode makes fewer print passes per raster line than does the second mode.

7. The method of claim 6, wherein the first mode makes only one print pass per raster line.

8. The method of claim 1, wherein the print medium is advanced a greater distance to the next raster line in the first mode than in the second mode.

9. The method of claim 1, wherein the "m" enabled nozzles are all working nozzles.

10. The method of claim 1, wherein the printing in the first and second modes occurs on the same sheet of print medium.

11. A method for operating a printer having vertically offset first and second printheads, wherein the first printhead has a first array of nozzles printing a first color, wherein the second printhead has a second array of nozzles printing a second color different from the first color, and wherein the method comprises the steps of:

a) advancing the print medium a first distance to a next raster line to be printed in a first mode;

b) printing in the first mode which enables a number "M" of vertically consecutive nozzles in the first array and which enables a number "N" of vertically consecutive nozzles in the second array;

c) advancing the print medium a second distance to a next raster line to be printed in a second mode, wherein the first distance is greater than the second distance; and d) printing in the second mode which enables only a number "m" of vertically consecutive nozzles in the first array and which enables only a number "n" of vertically consecutive nozzles in the second array, wherein "M" is greater than "m", "N" is greater than "n", "M" equals "N", "m" equals "n", and the "m" and "n" vertically consecutive nozzles define a common print region.

12. The method of claim 11, wherein the printing in the first mode occurs in a first print job and wherein the printing in the second mode occurs in a second print job.

13. The method of claim 11, wherein the printing in the first and second modes occurs in the same print job.

14. The method of claim 11, wherein "m" is a predetermined fixed number.

15. A method for operating a printer having vertically offset first and second printheads, wherein the first printhead has a first array of nozzles, wherein the second printhead has a second array of nozzles, and wherein the method comprises the steps of:

a) printing a first raster line which enables all of the nozzles in one of first and second arrays when the first raster line does not require printing by the other of the first and second arrays; and b) printing a second raster line which enables only common-print-region ones of the nozzles in the first and second arrays when the second raster line requires printing by both the first and second arrays.

16. The method of claim 15, wherein the nozzles of the first array print a first color and wherein the nozzles of the second array print a second color different from the first color.

17. The method of claim 15, wherein the first and second raster lines are printed in the same print job.

18. The method of claim 15, wherein the first and second raster lines are printed in different print jobs.

19. The method of claim 15, wherein the first raster line is printed in one pass and wherein the second raster line is printed in more than one pass.

20. The method of claim 15, wherein the second raster line is printed using a predetermined fixed number of common-print-region ones of the nozzles of the first and second arrays.

* * * * *